US005907889A

United States Patent [19]

Fukushima et al.

[11] Patent Number: 5,907,889

[45] Date of Patent: Jun. 1, 1999

[54] VACUUM CLEANER

[75] Inventors: Sadao Fukushima, Hyogo-ken; Shuzo Ueyama, Kasai; Kazumasa Kamatani; Shuichi Higuchi, both of Hyogo-ken, all of Japan

[73] Assignee: Sanyo Electric Co., Ltd., Osaka-fu, Japan

[21] Appl. No.: 08/802,281

[22] Filed: Feb. 19, 1997

[30] Foreign Application Priority Data

Feb. 20, 1996 [JP] Japan ..... 8-032032

[51] Int. Cl.[6] ..... A47L 9/14

[52] U.S. Cl. ..... 15/339; 15/352

[58] Field of Search ..... 15/327.2, 339, 15/347, 350, 351, 352; 55/369, 370, 378, DIG. 2, DIG. 3

[56] References Cited

U.S. PATENT DOCUMENTS

| | | | |
|---|---|---|---|
| 4,670,937 | 6/1987 | Sumerau et al. | 15/352 |
| 4,766,639 | 8/1988 | Lindquist et al. | 15/339 |
| 5,221,303 | 6/1993 | Guhne et al. | 15/352 |

FOREIGN PATENT DOCUMENTS

| | | | |
|---|---|---|---|
| 0 045 036 | 2/1982 | European Pat. Off. . | |
| 45036 | 2/1982 | European Pat. Off. | 15/339 |
| 0 178 607 | 4/1986 | European Pat. Off. . | |
| 63-83155 | 6/1988 | Japan . | |
| 63-186238 | 8/1991 | Japan . | |
| 5-154072 | 6/1993 | Japan | 15/339 |
| 2 097 284 | 11/1982 | United Kingdom . | |
| 2098056 | 11/1982 | United Kingdom | 15/339 |
| 2131320 | 6/1984 | United Kingdom | 15/339 |
| WO 95/15108 | 6/1995 | United Kingdom . | |

*Primary Examiner*—Terrence R. Till

*Attorney, Agent, or Firm*—Armstrong, Westerman, Hattori, McLeland & Naughton

[57] ABSTRACT

A vacuum cleaner comprising: a main body having a dust collecting chamber and a motor chamber; a cover for the dust collecting chamber; and an inlet pipe formed on the dust collecting chamber. A lever is provided within the dust collecting chamber, the lever being swingable between a position where one end of the lever is positioned between an opening edge of the dust collecting chamber and the cover to prevent the cover from closing and a position where the lever enables the cover to close. It is not possible to attach the cover to the cleaner in the state where the dust collecting bag is detached so that it is possible to securely prevent misuse of the cleaner in the state where the dust collecting bag is not attached.

9 Claims, 16 Drawing Sheets

VACUUM CLEANER

BACKGROUND OF THE INVENTION

The present invention relates to a vacuum cleaner containing a paper pack.

Conventionally, there is a cleaner such as that described in Japanese Unexamined Patent Publication No. 186238/1991 (A47L 5/28) as a vacuum cleaner containing a paper pack in the dust collecting chamber. In this upright type vacuum cleaner, an inlet opening to which a hose is connected is formed on the rear surface of the main body, namely, on the innermost side of the dust collecting chamber and the mouth plate of the paper pack is press-fitted on this inlet opening.

In this configuration, the paper pack body is larger than the mouth plate so that there was a disadvantage that it is difficult to grasp the mouth plate with poor operability of replacing the paper pack when replacing the paper pack swelled with filled dust.

Moreover, in the canister type vacuum cleaner, it has a disadvantage that it is difficult to attach and detach the paper pack since a cylindrical inlet opening is formed in the front section of the cleaner main body.

As a technique to solve the above disadvantage, there is a vacuum cleaner in which a detaching tool supported on the innermost side of the dust collecting chamber is operated to apply a force to the mouth plate in the detaching direction (refer to Japanese Unexamined Utility Model Publications No. 83155/1988 and No. 88260/1988).

However, the detaching tool is a bar-shaped member whose front has an approximate ⊓ shape and whose both ends are rotatable in a position near the both sides of the inlet opening. The operating portion in the middle of the bar-shaped member extends to the opening side of the dust collecting chamber and only faces to the opening, so it is possible that the dust cover is attached, with the dust pack being detached. In such case, there is a disadvantage that the sucked dust is scattered in the dust collecting chamber when the vacuum cleaner is operated by mistake. Moreover, when detaching the paper pack with the use of the detaching tool, there is a disadvantage that it is not easy to smoothly attach and detach the paper pack due to bending of the mouth plate to the inlet opening side, since the detaching tool is pressed to the upper ends of the mouth plate.

The present invention is made in view of the above disadvantage and has an object to provide a vacuum cleaner capable of attaching a paper pack without fail and easily replacing the paper pack.

SUMMARY OF THE INVENTION

In accordance with the present invention, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; and the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close.

Further, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the one end of the lever is positioned between the opening edge of the dust collecting chamber and the cover for the dust collecting chamber while the other end of the lever is formed with an encircling portion for encircling a periphery of the inlet pipe to swing the lever by means of the dust collecting bag by attaching the dust collecting bag to the inlet pipe so that one end of the lever is retracted to the position where the lever enables the cover for dust collecting chamber to close.

Moreover, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a restricting rib which restricts swinging of the lever at a retracted position of the lever in the dust collecting chamber is formed at a rear surface of the cover for the dust collecting chamber.

Still further, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a portion of the other end of the lever, the portion being on the tip end side from an approximate center portion of the inlet pipe, is inclined in a direction separating from a mouth plate of the dust collecting bag.

Further, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a positioning rib for positioning a mouth plate of the dust collecting bag is formed on a top surface of the other end of the lever.

Moreover, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a rib extending in an axial direction of the inlet pipe is formed on an outer surface of the inlet pipe.

Still further, there is provided a vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a guide portion is integrally formed with an opening edge of the inlet pipe toward a center of the inlet pipe.

It is desirable to provide a forcing means which forces the lever to a position where one end of the lever prevents the dust collecting chamber from being closed.

Moreover, it is desirable that the lever is shaped so that one end of the lever is swung with self-weight to a position where the dust collecting chamber is prevented from being closed.

Moreover, it is possible to apply the present invention to a configuration where the body is swingably supported on the sucking body, namely, to an upright type vacuum cleaner.

DETAILED DESCRIPTION

Figure 1:
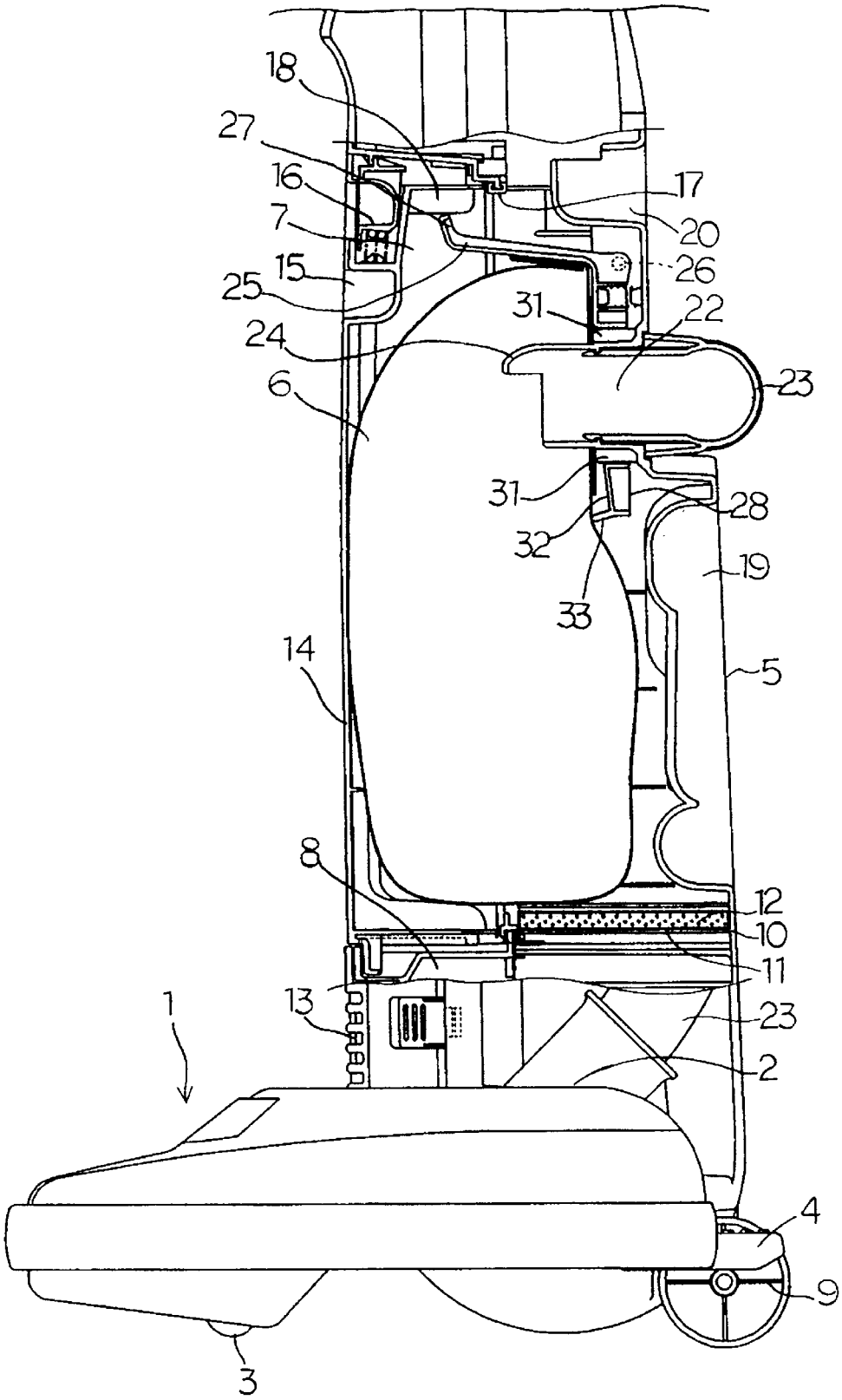
FIG. 1 is a cross-sectional side view of a main portion of an upright type vacuum cleaner in operating state (state where a dust collecting bag is attached) of one embodiment of the present invention.
Figure 2:
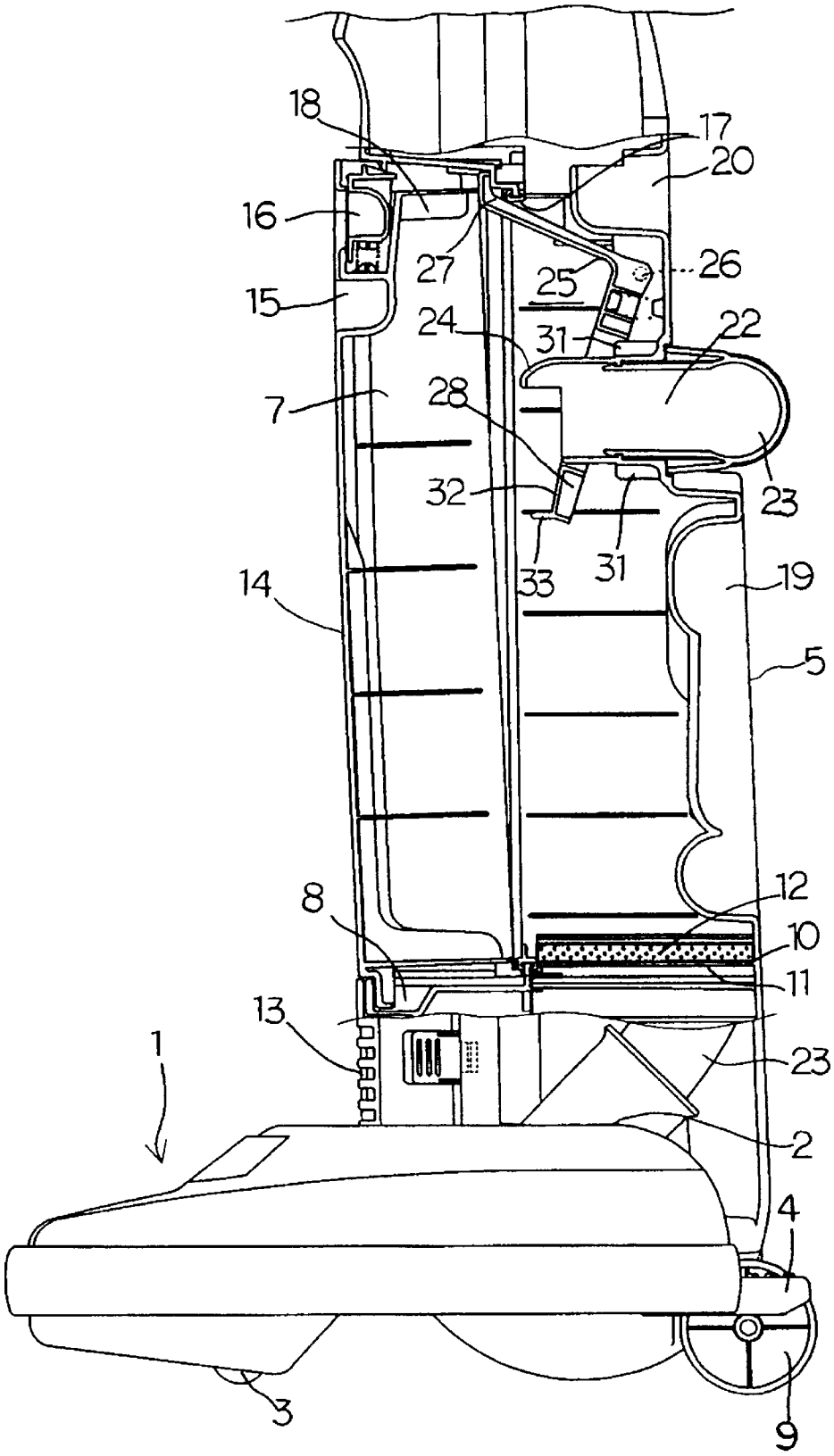
FIG. 2 is a cross-sectional side view of the main portion when the dust collecting bag is not attached.

One embodiment of the present invention is described in detail based on the upright type cleaner shown in the figures.

Numeral 1 indicates a sucking main body having an opening (not shown) on the bottom thereof and containing a rotating brush (not shown) near the opening. The rotating brush is connected to a rotation shaft of an electric blower (not shown) contained in the lower part of the main body 5 described later and driven to rotate.

A connection port 2 which communicates with the opening and to which a hose 23 to be described later is connected is formed on the upper part of the sucking main body 1. Numeral 3 indicates a pair of right and left wheels arranged in front of the sucking main body 1. Numeral 4 indicates a pedal which is stepped down to release lock of the body 5 to be described later against the sucking main body 1 in a upright position, and to allow the body 5 to fall with respect to the sucking main body 1.

Numeral 5 indicates a freely tilting main body supported on the sucking main body 1 with a shaft, and forms a dust collecting chamber 7 with a front opening which detachably containing a dust collecting bag 6 having a mouth plate 6*a* upward and an electric blower containing chamber 8 with a front opening containing an electric blower (not shown) downward. A pair of right and left wheels 9,9 is arranged on the lower rear of the main body 5. A vent hole 11 is formed on a separation wall 10 between the dust collecting chamber 7 and electric blower containing chamber 8. A filter 12 is arranged in the vent hole 11 to prevent invasion of fine dust from the dust collecting chamber 7 into the electric blower containing chamber 8. Numeral 13 indicates a discharge port formed on the front of the electric blower containing chamber 8.

Numeral 14 indicates a cover for the dust collecting chamber covering the opening of the dust collecting chamber 7 and includes a dent section 15 for grip and a clamp 16. The clamp 16 is operated to detachably attach the cover 14 to the opening of the dust collecting chamber 7. The cover 14 can be air-tightly attached on the main body 5 with a packing 17 arranged on the opening edge of the dust collecting chamber 7 of the main body 5.

Numeral 18 indicates a restricting rib formed on the upper rear surface of the cover 14, and is designed to contact with an end surface of a blocking portion 27 of the lever 25 to be described later in the state where the lever 25 is retracted to the dust collecting chamber 7 to restrict the swinging of the lever 25, whereby preventing the dust collecting bag 6 from falling off from the inlet pipe 22 described later.

Numeral 19 indicates an accommodating dent section formed on the rear surface of the main body 5 to accommodate sucking attachment for furniture to be attached on the tip of a hose 23 (described later) after detaching the end of the hose 23 on the connection port side when a sofa or the like is cleaned. Numeral 20 indicates a dent for inserting a hand formed on the upper rear surface of the main body 1, which is designed in such a way that a hand is inserted in the inner top surface of this dent 20 when a person carries the cleaner.

Numeral 21 indicates a slide switch (refer to FIG. 11) arranged on the upper part of the dust collecting chamber 7 of the main body 1, which is designed in such a way that the slide switch 21 is operated to control output of the electric blower in accordance with the sort of the cleaning surface such as flooring and carpet.

Numeral 22 indicates an inlet pipe formed on the rear wall of the dust collecting chamber 7, namely, the rear side of the main body 1, and a hose 23 is connected to the opening of the inlet pipe 22 and the connection port 2 of the sucking main body 1. Numeral 24 indicates a guide portion formed integrally with the opening edge of the inlet pipe 22. The guide portion 24 is so formed to bend toward the center of the opening (downwardly of the dust collecting chamber 7 in this embodiment), and is designed to guide the opening of the mouth plate 6*a* when a dust collecting bag 6 is attached to the inlet pipe 22 whereby enabling easy attachement of the mouth plate 6*a* even if the opening of the mouth plate 6*a* is displaced to the inlet pipe 22, and to guide the dust sucked from the hose 23 to the innermost part of the dust collecting bag 6.

Numeral 25 indicates a lever having a L-shaped cross-section, which has a fulcrum 26 provided on the rear wall of the dust collecting chamber 7 and swingably attached to the rear wall. The lever 25 has at one end thereof a blocking portion 27 positioned between an opening edge of the dust collecting chamber 7 and the cover 14 for the dust collecting chamber to prevent the cover 14 from being attached on the dust collecting chamber 7 and at the other end thereof an encircling portion 28 which loosely encircles over all the circumference of the inlet pipe 22.

The lever 25 is energized with a spring 30 to one end thereof, namely, in the direction to rotate the blocking portion 27 so that the blocking portion 27 is always positioned on the opening edge of the dust collection chamber 7 in the state where the dust collecting bag 6 is not attached to the inlet pipe 22 and, by attaching the dust collecting bag 6 to the inlet pipe 22, the encircling portion 28 is pressed to the rear side of the main body 5 with the mouth plate 6*a* of the dust collecting bag 6 to rotate the lever 25, whereby the blocking portion 27 retracts into the dust collecting chamber 7.

Numeral 31 indicates a guide rib formed on the outside circumferential surface of the inlet pipe 22 in the axial direction. The guide rib 31 guides the encircling portion 28 when the lever 25 swings, and the lever 25 can smoothly swing even if a force is applied to the direction different from the swinging direction of the lever 25 when the lever 25 swings. The outer diameter of the guide rib 31 is set to such a dimension that the lever 25 does not contact with the inlet pipe 22 when the lever 25 swings to the blocking portion 27 side.

Numeral 32 indicates an inclined surface formed on the outermost end side from the center of the inlet pipe 22 on the upper surface of the encircling portion 28 of the lever 25. The inclined surface 32 is inclined to the direction to separate from the mouth plate 6*a* of the dust collecting bag 6, namely, to the rear side of the main body 5 in the state where the lever 25 swings to the encircling portion 28 side against the energizing force of the spring 30. The inclined surface 25 is so designed that, when the blocking portion 27 of the lever 25 is pressed to detach the dust collecting bag 6, a portion of the mouth plate 6*a* of the dust collecting bag 6 on the encircling portion 28 side is prevented from being excessively pulled up to suppress the friction between the opening of the mouth plate 6*a* and the outside circumferential surface of the inlet pipe 22, allowing the dust collecting bag 6 to be easily removed.

Numeral 33 indicates a positioning rib formed on the top surface of the outermost end of the encircling portion 28. The positioning rib 33 positions a mouth plate 6*a* of a dust collecting bag 6 when the dust collecting bag 6 is attached to the inlet pipe 22.

Figure 7:
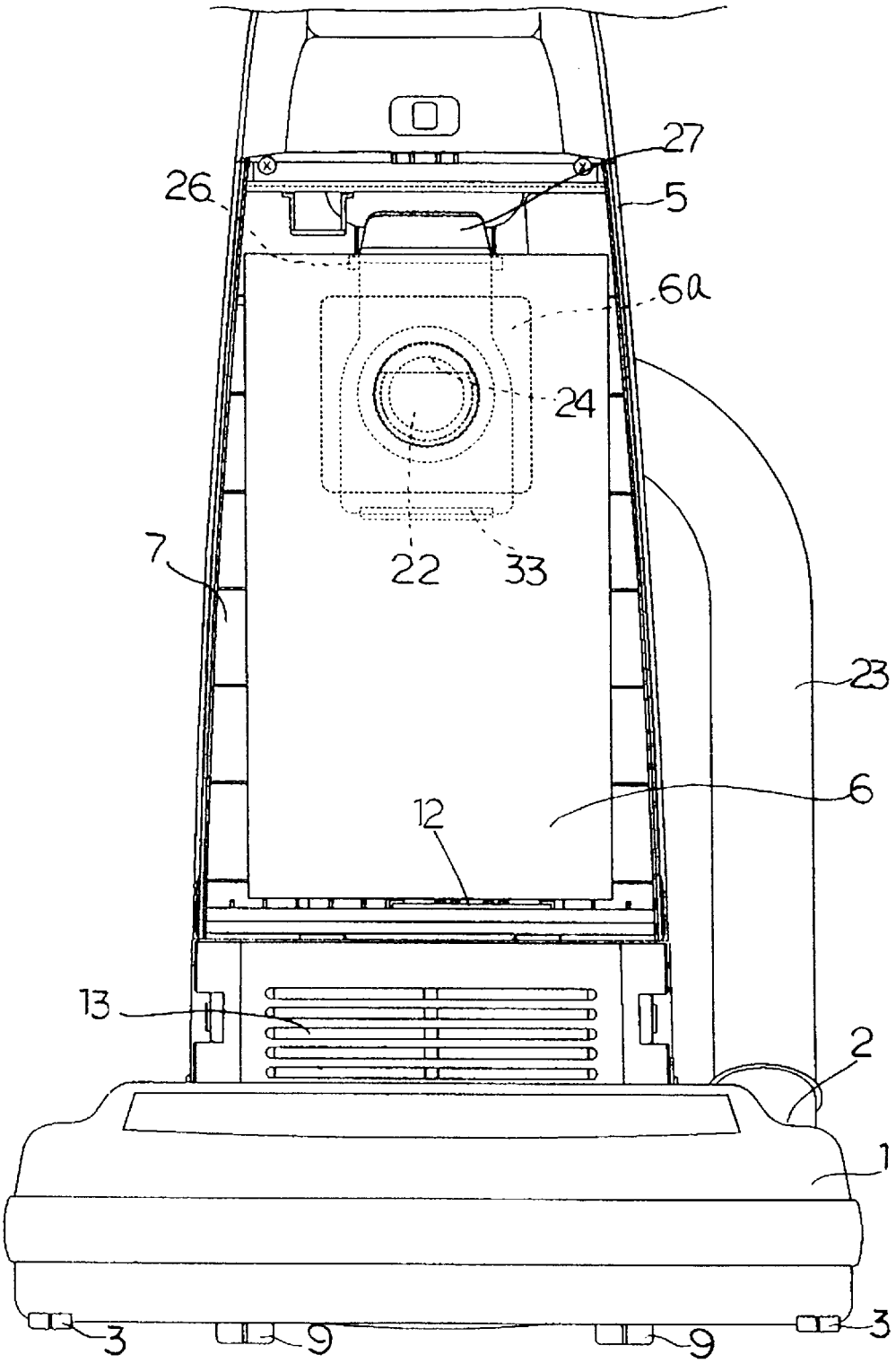
FIG. 7 is a front view of the vacuum cleaner in the state where the cover for the dust collecting chamber is detached (when the dust collecting bag is attached)
Figure 15:
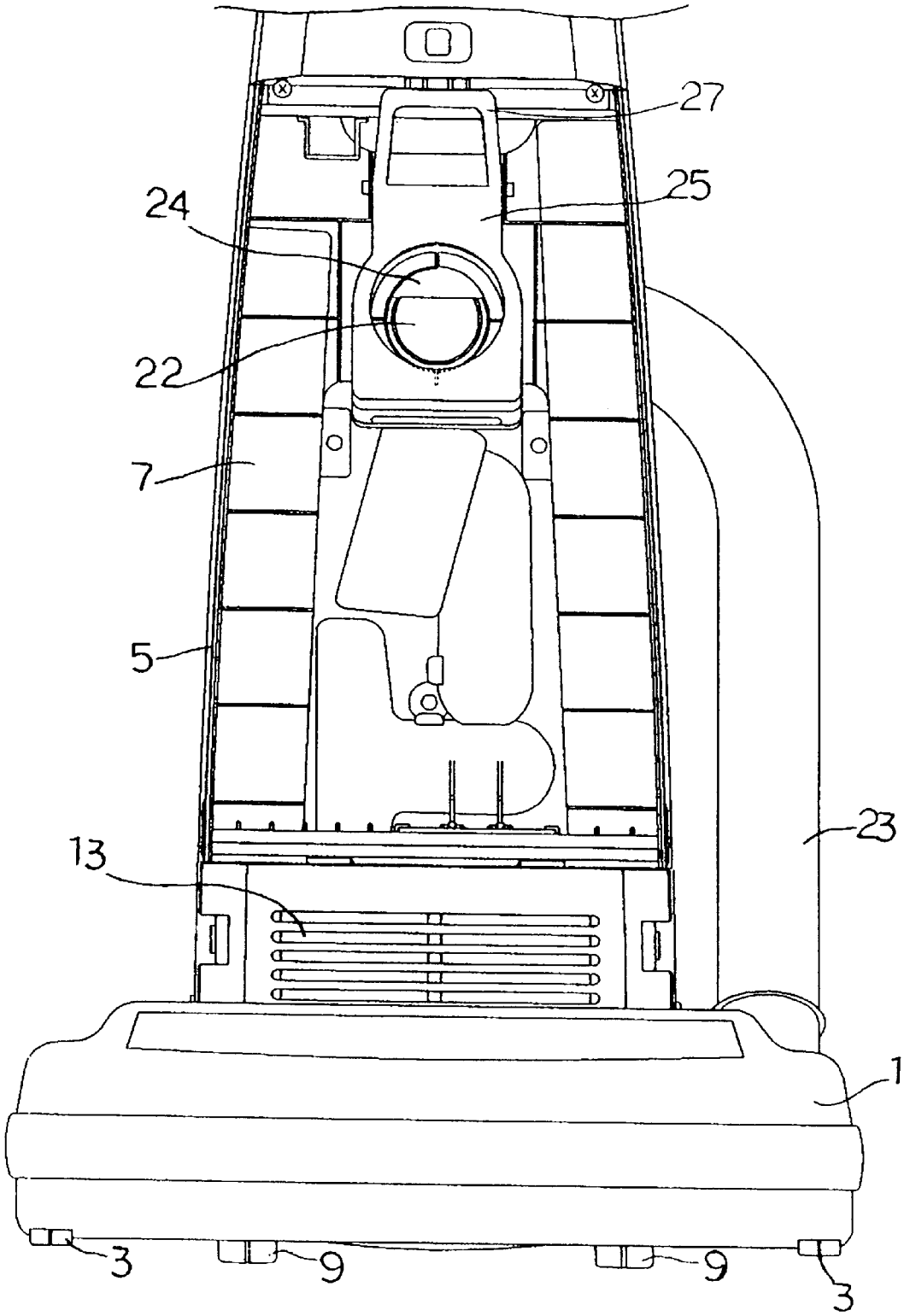
FIG. 15 is a referential view for explaining the effect of this embodiment.
Figure 16:
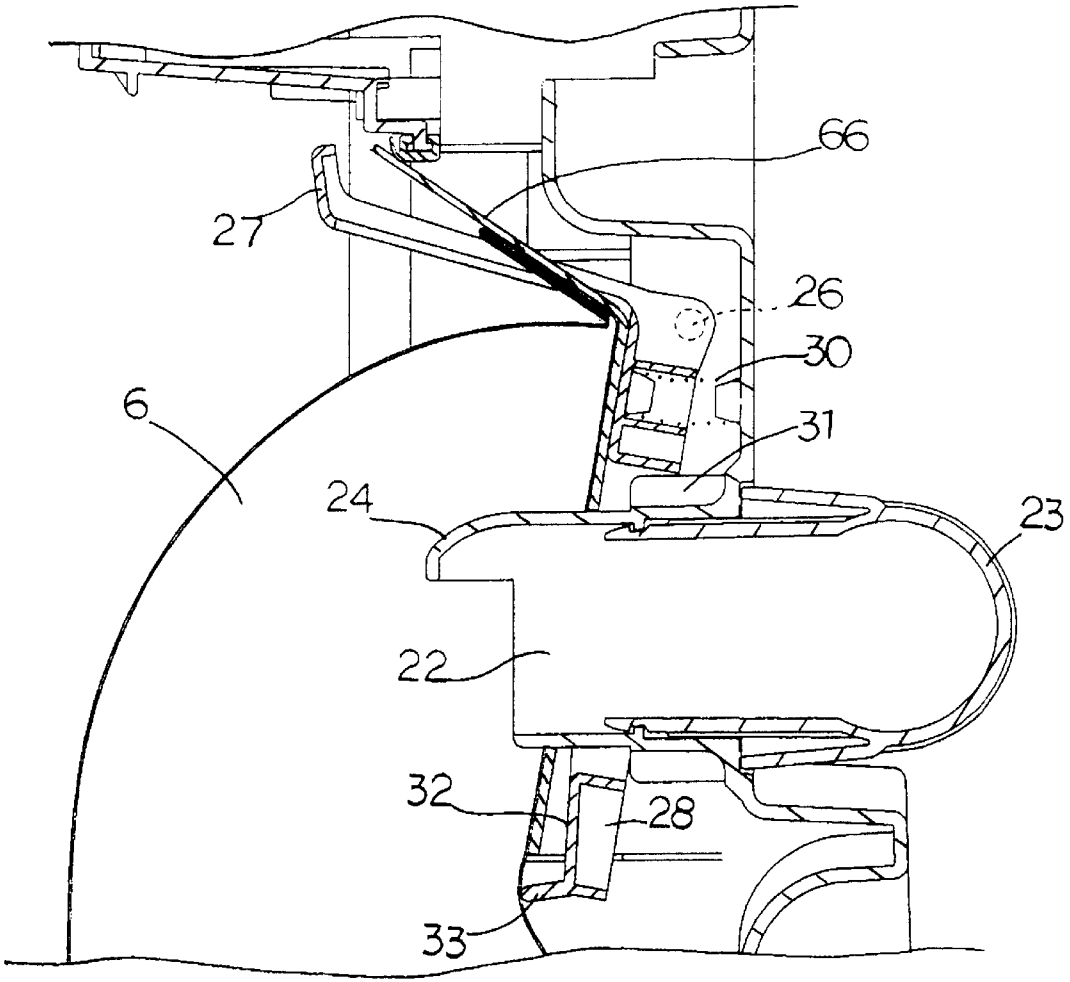
FIG. 16 is a magnified cross-sectional view of the main portion.

If the blocking portion 27 of the lever 25 is formed in a shape of ⊓ as shown in FIG. 15, it is conceivable that, when the dust collecting bag 6 is designed in such a way that a flap 6*b* is formed on its mouth plate as a grip as shown in FIG. 16, the flap 6*b* falls down and comes off from the opening of the blocking portion 27, and positioned on the opening edge of the dust collecting chamber 7, resulting in that the flap 6*b* is engaged between the opening of the dust collecting chamber 7 and the cover for the dust collecting chamber when attaching the cover 14. However, in this embodiment, such problem does not occur since the blocking portion 27 of the lever 25 is formed in a shape of plate as shown in FIGS. 7 and 8.

Moreover, in order to accomplish the same effects, it is possible to form the blocking portion 27 of the lever 25 in a shape of ⊓ and to integrally form a connecting section 27*a*, that prevents the flap 6*b* from falling down, by connecting the opening of the blocking portion 27.

Figure 11:
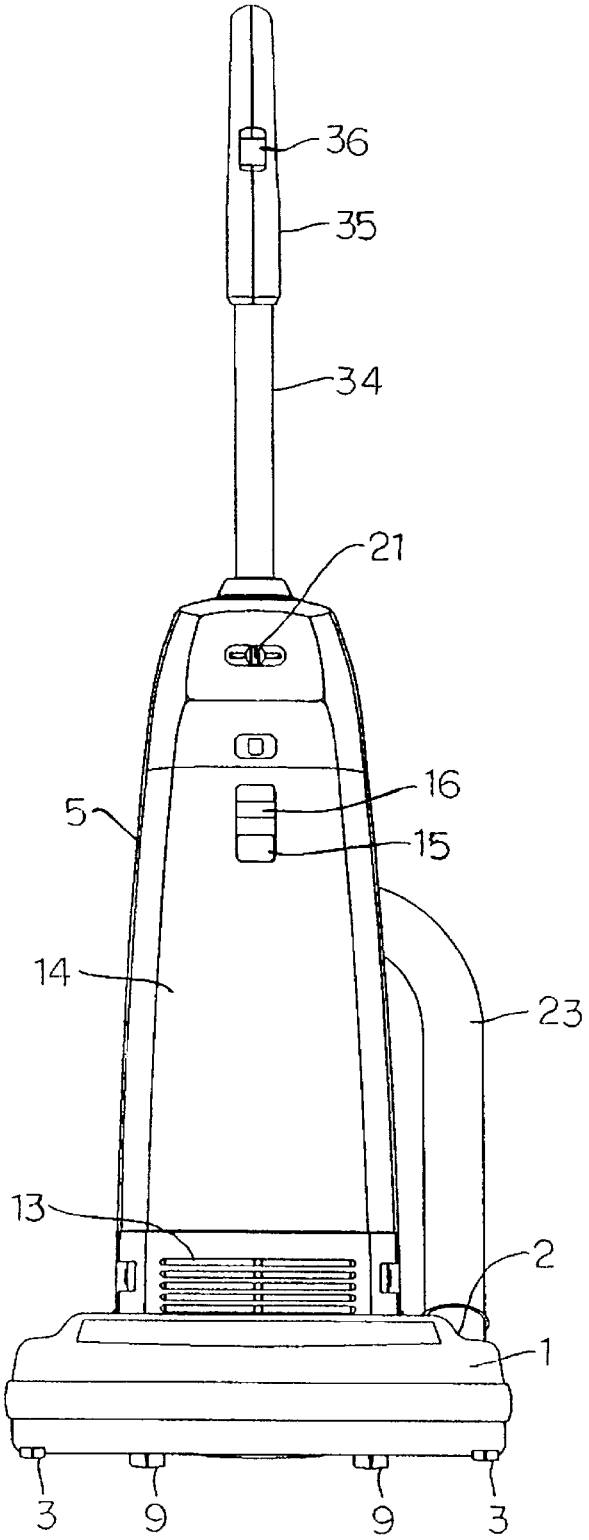
FIG. 11 is an outside front view of the upright type vacuum cleaner.
Figure 12:
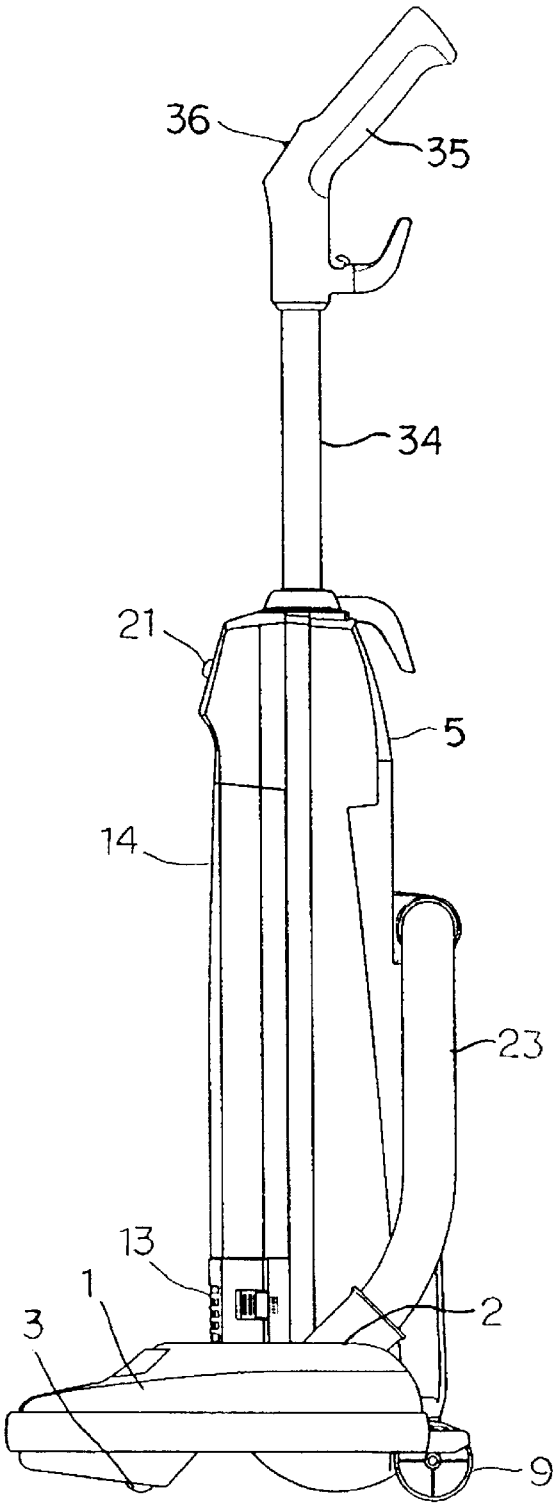
FIG. 12 is an side view of the upright type vacuum cleaner.
Figure 13:
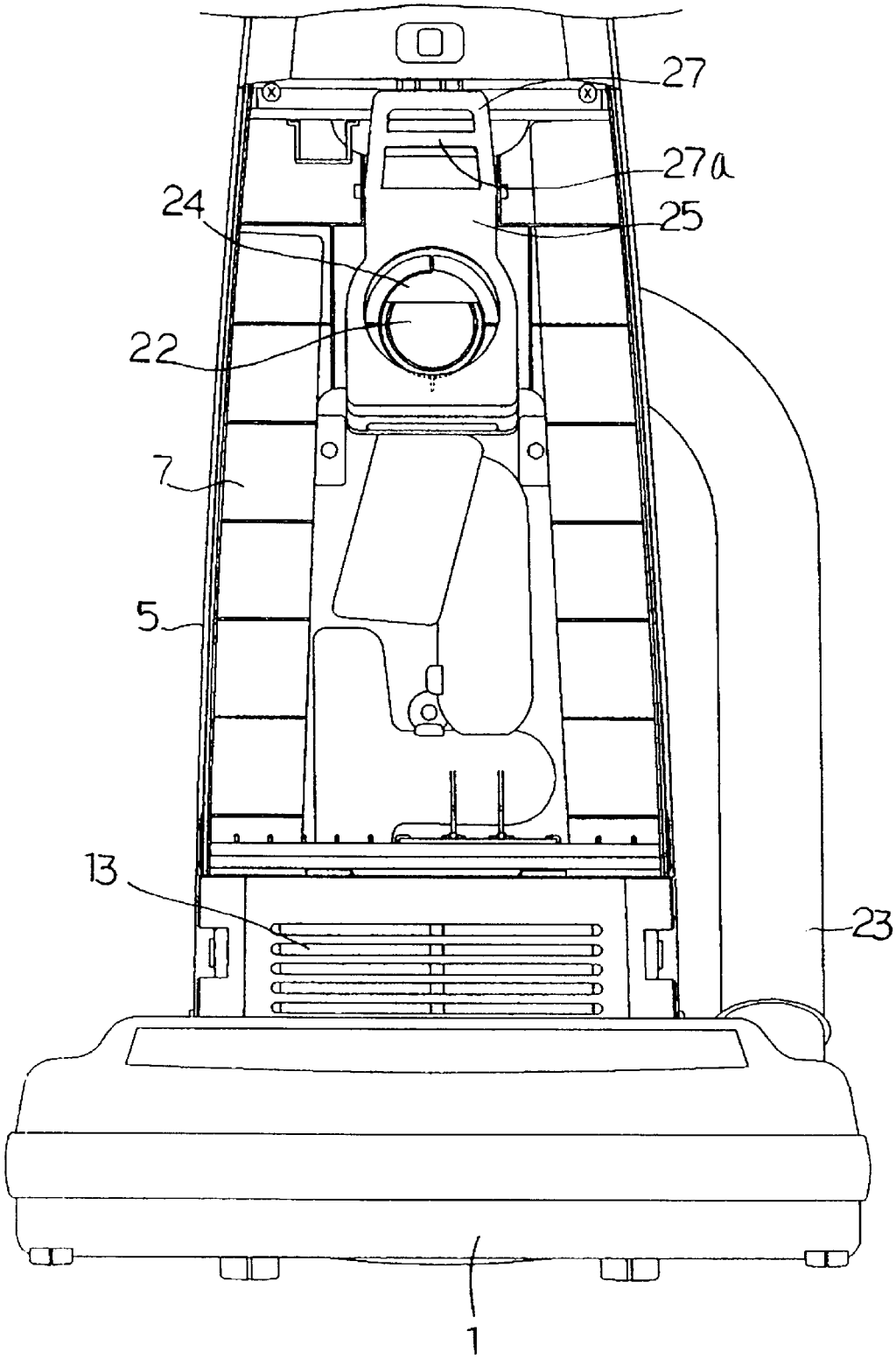
FIG. 13 is a front view showing the state where the cover for the dust collecting chamber is detached (when the dust collecting bag is not attached) in an upright type vacuum cleaner of another embodiment.
Figure 14:
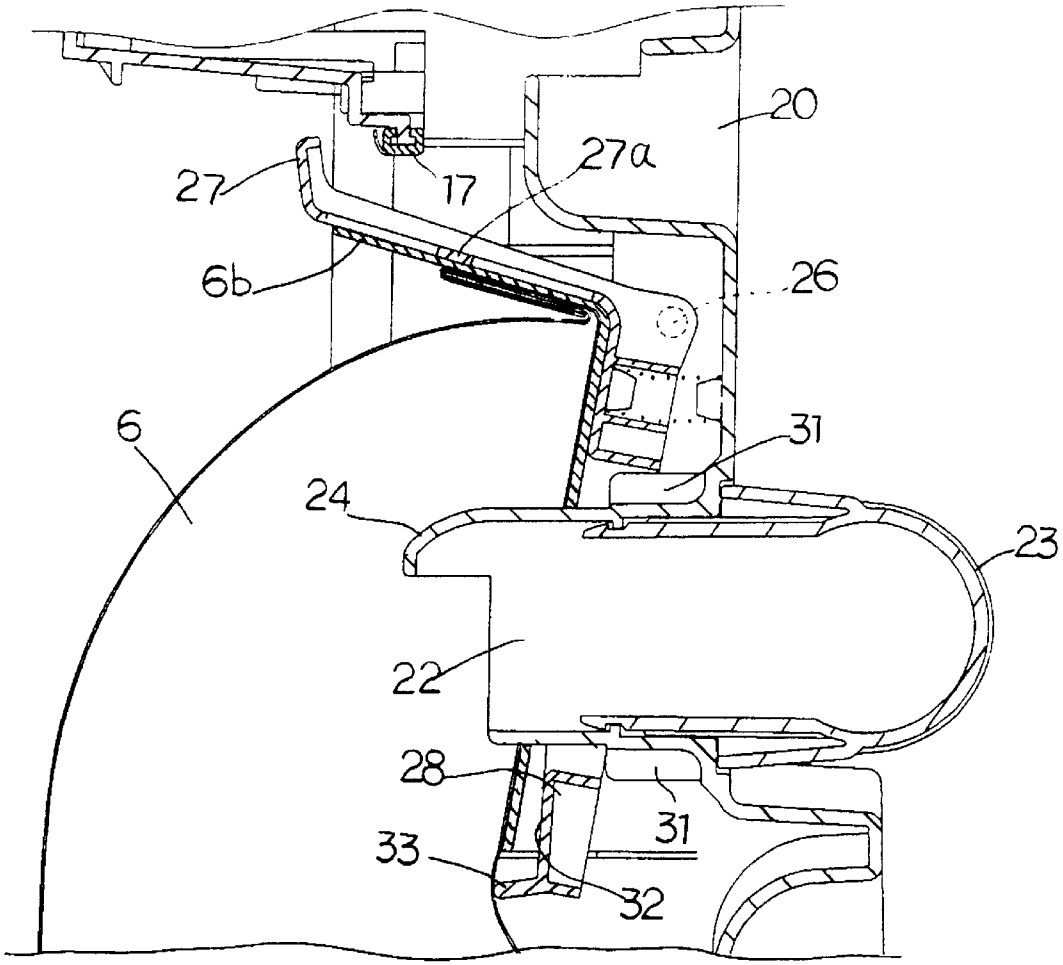
FIG. 14 is a magnified cross-sectional view of the main portion of the vacuum cleaner.

Numeral 34 indicates a handle attached on the upper surface of the main body 5 as shown in FIGS. 11 to 12. A power switch 36 is arranged on a grip portion 35 formed on the end of the handle 34.

Figure 8:
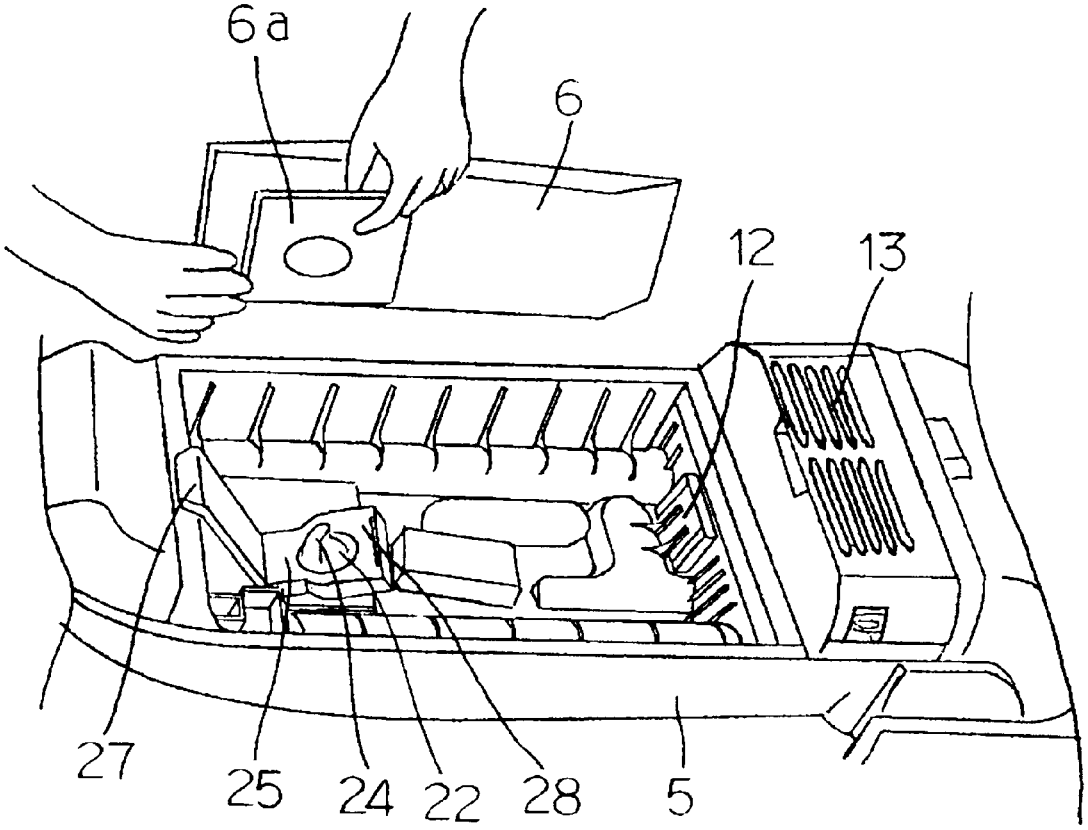
FIG. 8 is a perspective view of the main portion showing operation when the dust collecting bag is attached.

At the time of operation, a pedal 4 is stepped down to release the lock of the main body 5 against the sucking main body 1, the mouth plate 6*a* of the dust collecting bag 6 is press-fitted to be attached to the inlet pipe 22 of the dust collecting chamber 7 in the state where the main body 5 is fallen down as shown in FIG. 8. In this instance, the mouth plate 6*a* is matched to the positioning rib 33 formed on the encircling portion 28 of the lever 25 to easily attach the dust collecting bag 6 to the inlet pipe 22, while the encircling portion 28 of the lever 25 is pressed to the mouth plate 6*a* to rotate the lever 25 to the rear side of the main body 5, and the blocking portion 27 is retracted from the opening edge of the dust collecting chamber 7 to allow the cover 14 to be attached to the opening of the dust collecting chamber 7.

Moreover, a guide portion 24 is formed on the inlet pipe 22 and the opening of the mouth plate 6*a* of the dust collecting bag 6 is guided so that it is possible to securely attach the dust collecting bag 6 to the inlet pipe 22 even if the dust collecting bag 6 is displaced from the inlet pipe 22 when the dust collecting bag 6 is attached to the inlet pipe 22.

Moreover, the encircling portion 28 of the lever 25 is guided by the guide rib 31 formed on the outside circumferential surface of the inlet pipe 22 so that the lever 25 swings smoothly even if a force is applied to the direction other than the swinging direction of the lever 25, for example, in the direction of twist.

A restricting rib 18 which restricts the swinging of the lever 25 by contacting with the blocking portion 27 of the lever 25 in the state where the lever 25 is retracted in the dust collecting chamber 7 is formed on the rear surface of the cover 14, so that the mouth plate 6*a* of the dust collecting bag 6 is not pressed against the blocking portion 27, thereby the dust collecting bag 6 will not come off by accident.

When the power switch 36 provided on the grip portion 35 of the handle 34 is operated to drive the electric blower, the air sucked from the opening of the sucking main body 1 is guided through the connection port 2, the hose 23, and the inlet pipe 22 to the dust collecting chamber 7, and the dust is caught with the dust collecting bag 6 and the filter 12 arranged in the vent hole 11 of the separation wall 10 between the dust collecting chamber 7 and electric blower containing chamber 8 and the air is discharged from the discharge port 13 of the electric blower containing chamber 8. The air sucked in the dust collecting chamber 7 is guided via the guide portion 24 formed in the inlet pipe 22 to the innermost side of the dust collecting bag 6, namely, the lower side of the main body 5, thereby making it possible to prevent the early clogging of the dust collecting bag 6.

Figure 3:
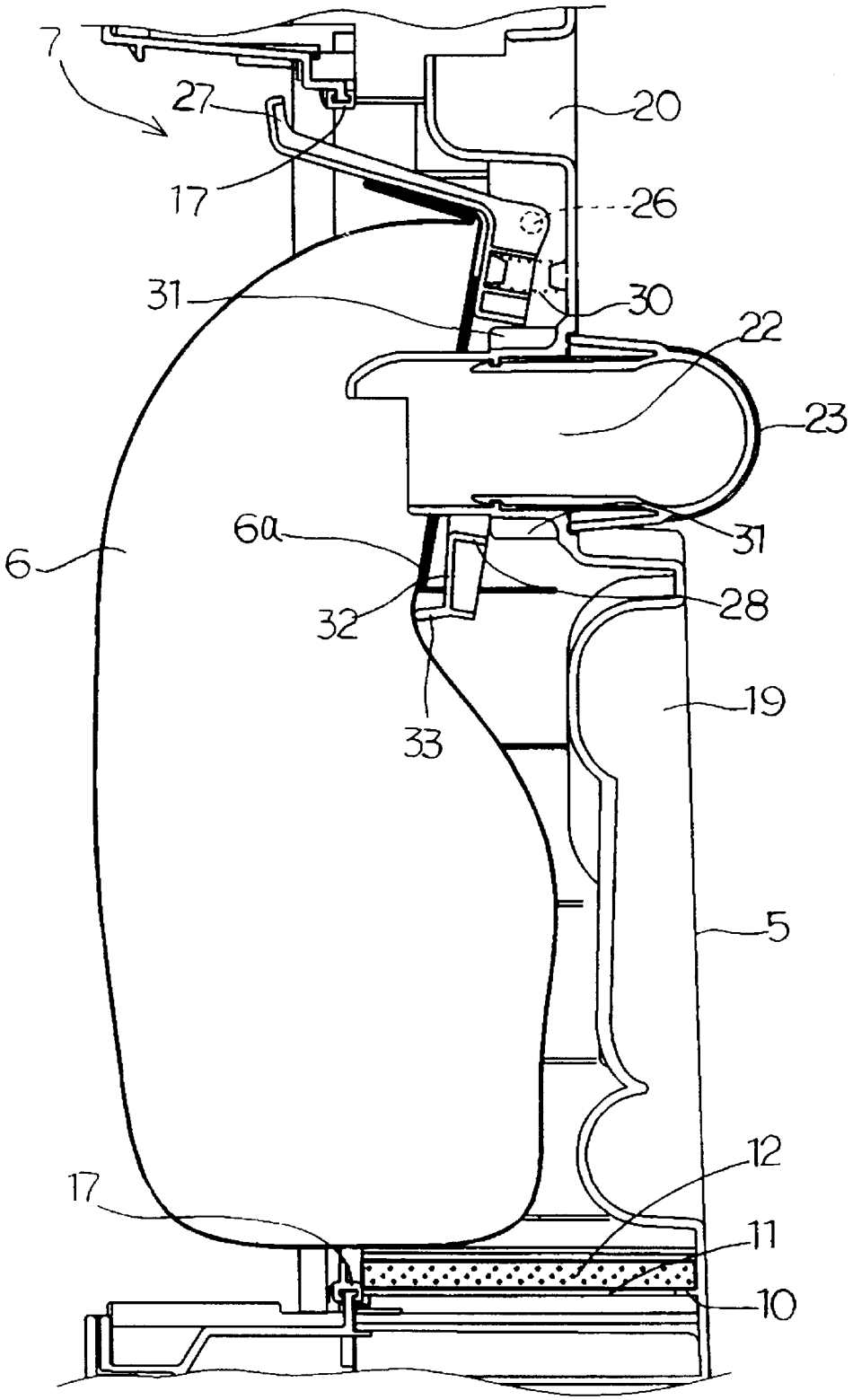
FIG. 3 is a cross-sectional view when the dust collecting bag is detached.
Figure 4:
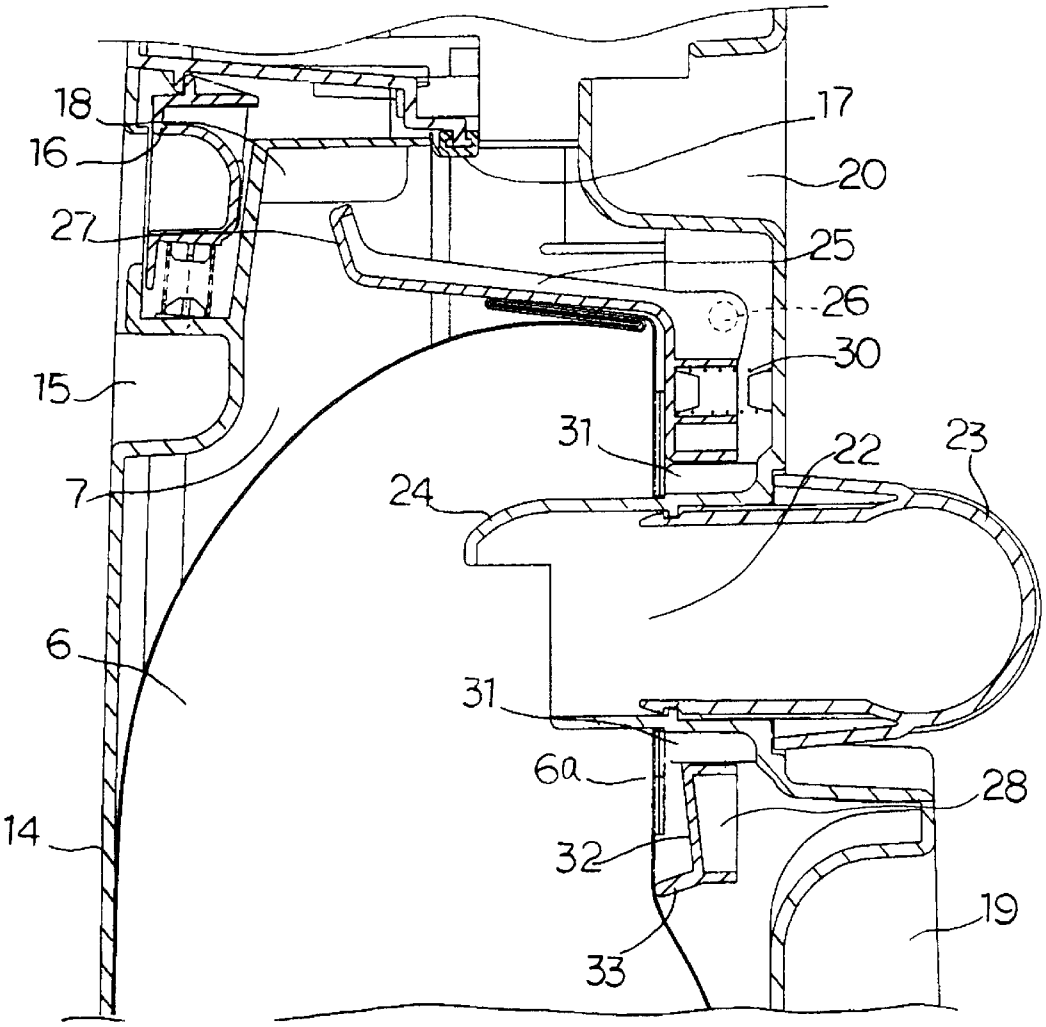
FIG. 4 is an magnified view of the main portion of FIG. 1.
Figure 5:
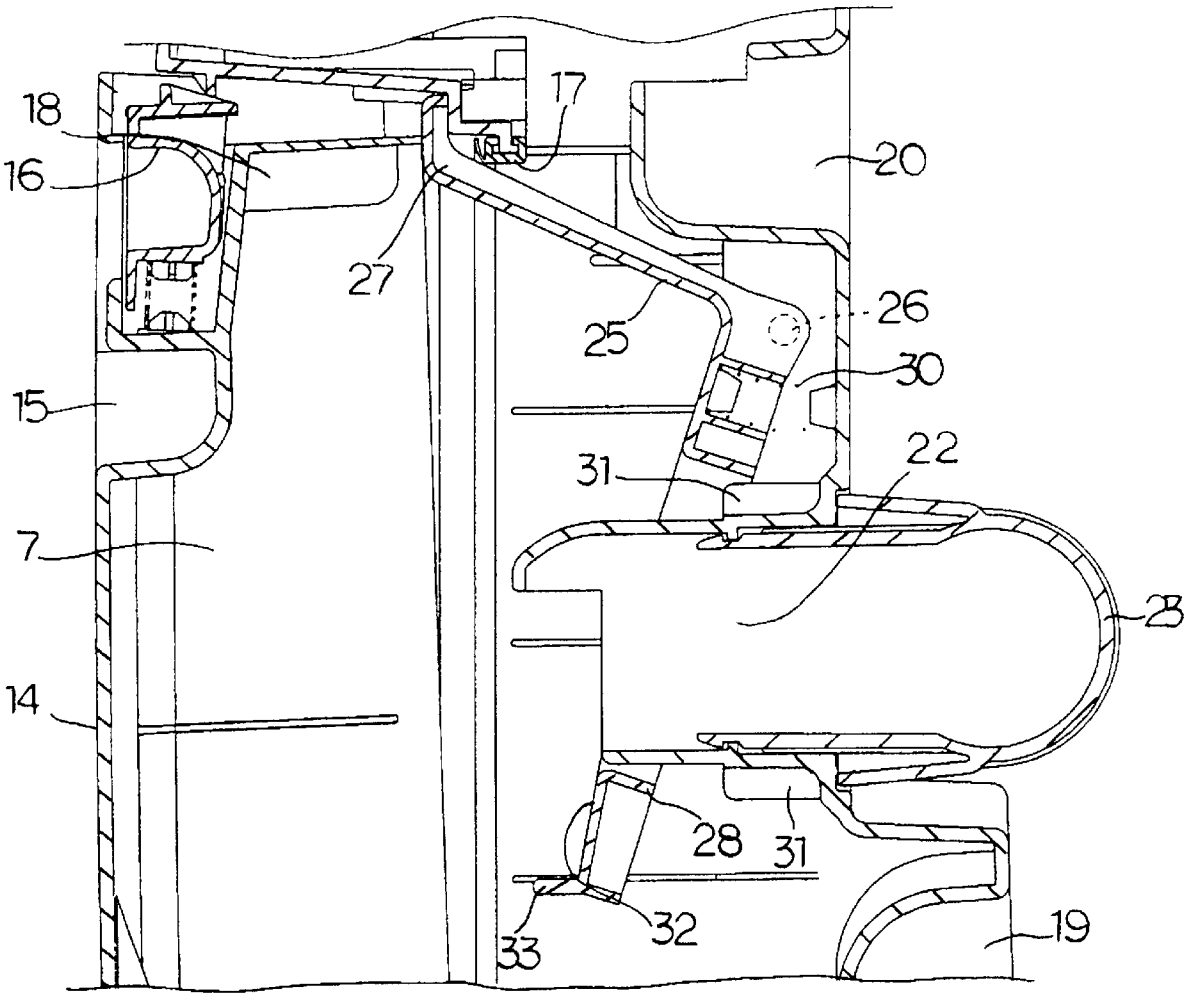
FIG. 5 is an magnified view of the main portion of FIG. 2.
Figure 6:
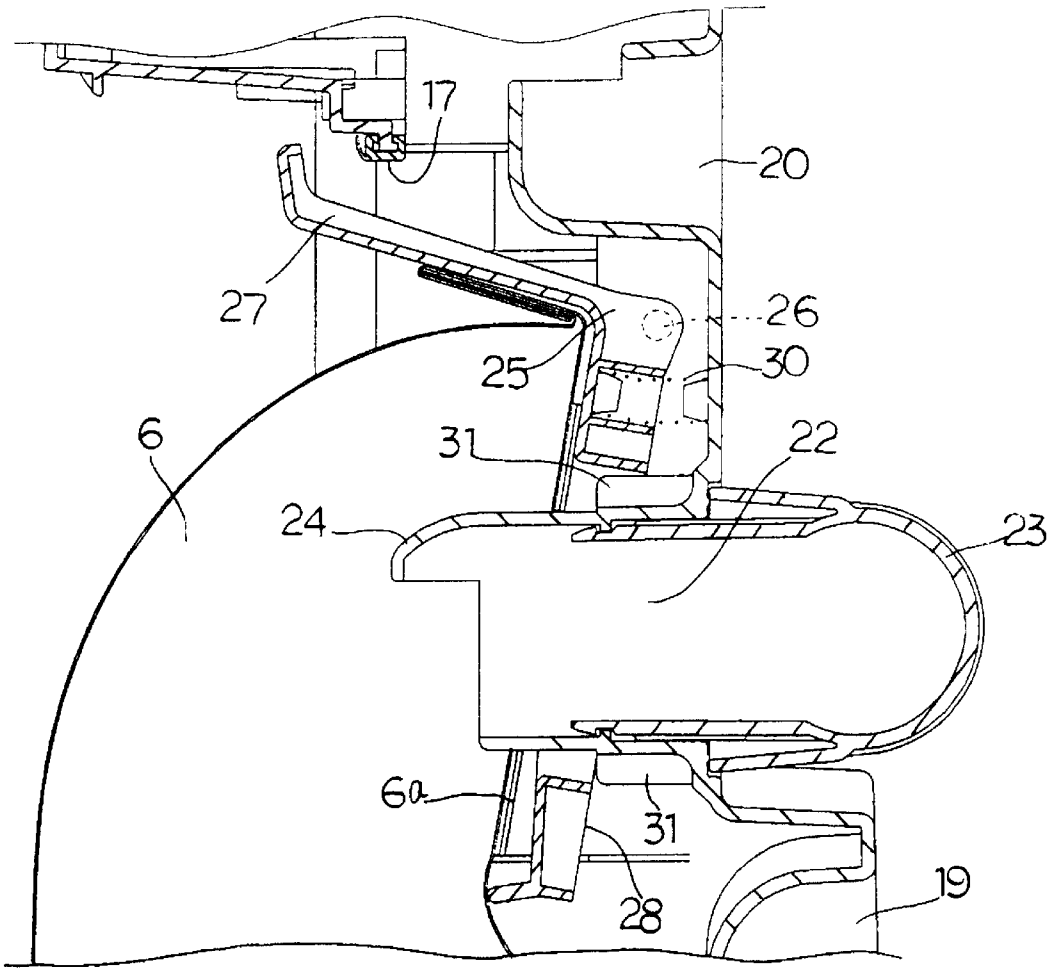
FIG. 6 is an magnified view of the main portion of FIG. 3.
Figure 9:
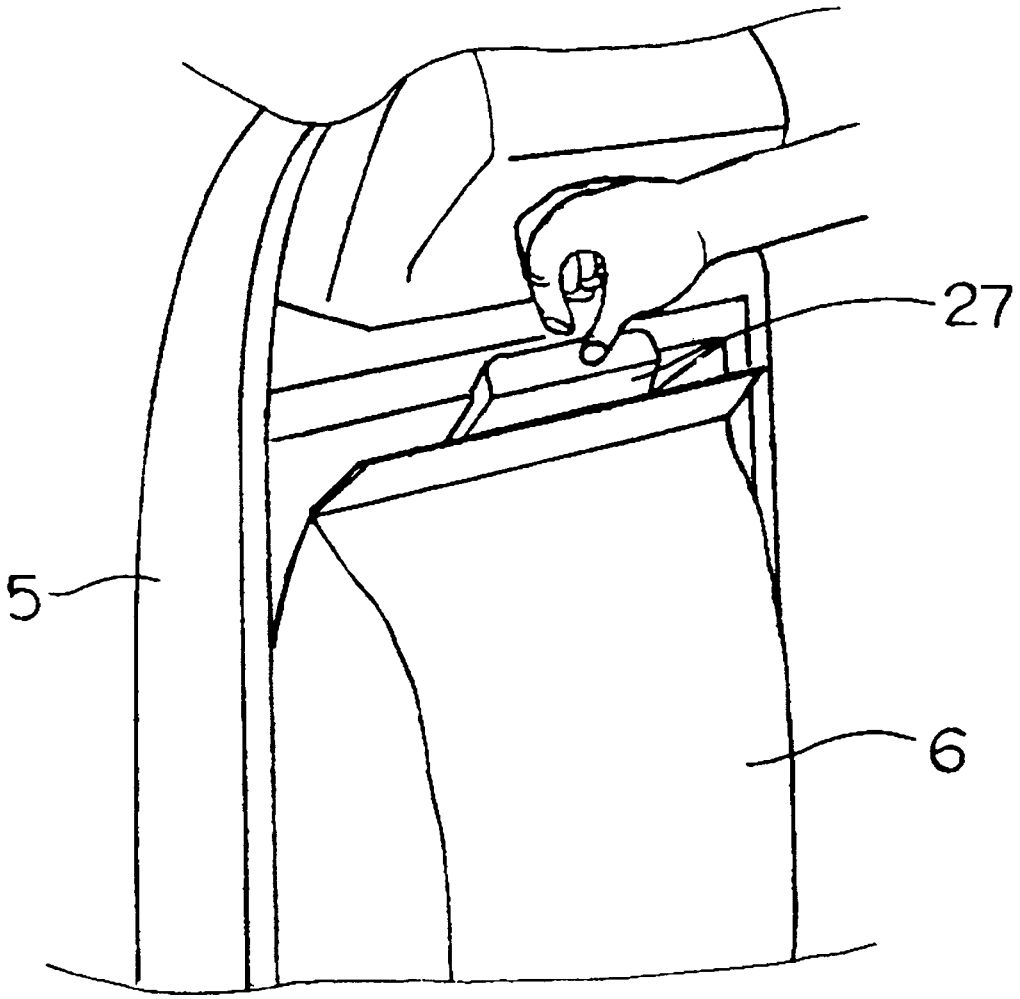
FIG. 9 is a perspective view of the main portion showing operation when the dust collecting bag is detached.
Figure 10:
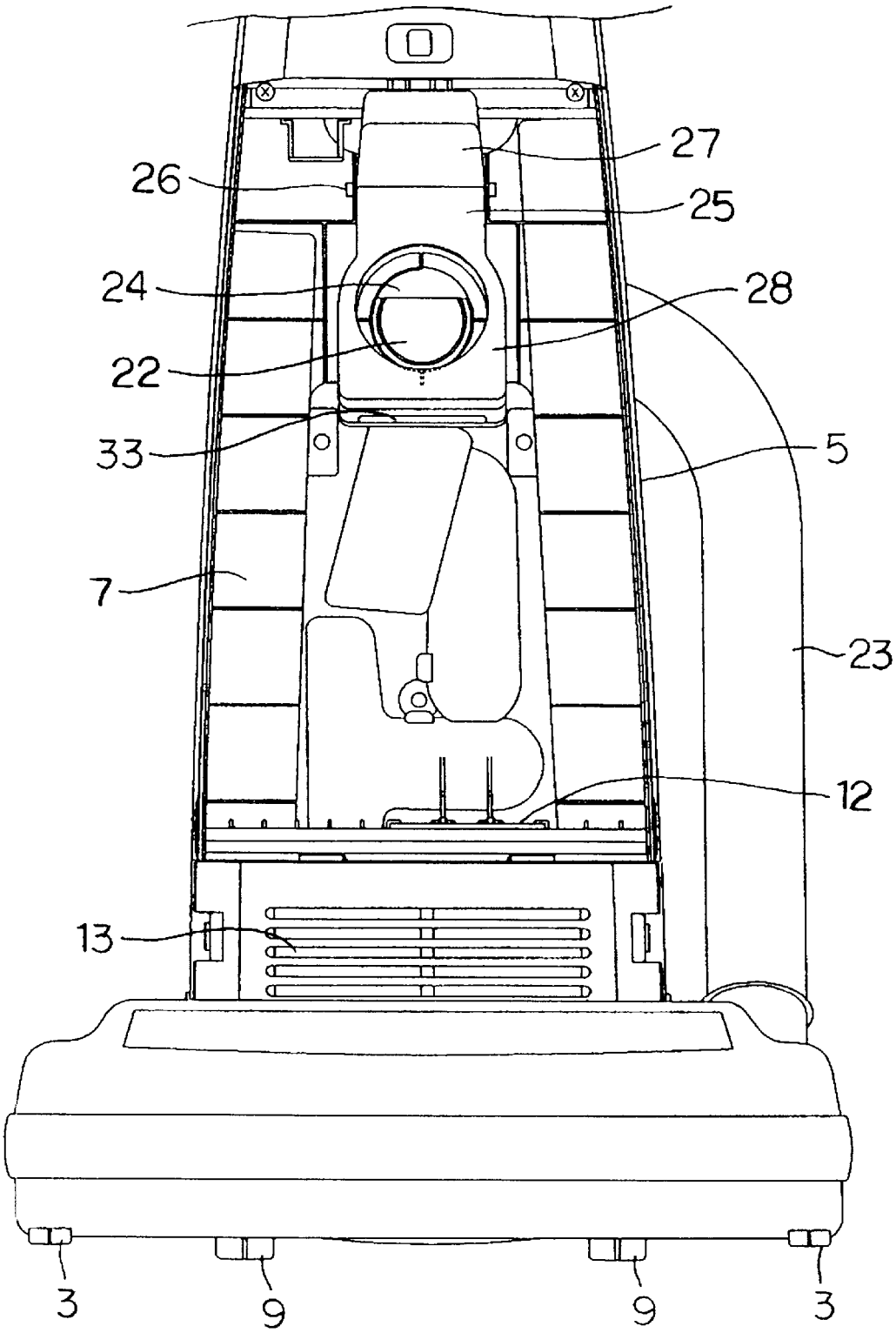
FIG. 10 is a front view of the vacuum cleaner in the state where the cover for the dust collecting chamber is detached (when the dust collecting bag is detached)

When replacing the dust collecting bag 6, the clamp 16 on the cover 14 is operated to pull out the cover 14. If the blocking portion 27 of the lever 25 is pressed as shown in FIGS. 3 and 9, the encircling portion 28 of the lever 25 pulls up the mouth plate 6*a* of the dust collecting bag 6 in the direction where it comes off from the inlet pipe 22 to allow the dust collecting bag 6 to be easily removed, thereby making it possible to improve the replacing workability of the dust collecting bag 6.

Moreover, an inclined surface 32 which is inclined in the direction where it separates from the mouth plate 6*a* of the dust collecting bag 6 is formed on the upper surface of the encircling portion 28 of the lever 25 so that it prevent the mouth plate 6*a* on the encircling portion 28 side from being pulled up when the dust collecting bag 6 is detached, thereby the opening of the mouth plate 6*a* is prevented from being engaged in the outside circumference of the inlet pipe 22 and it is easy to take out the dust collecting bag 6.

The lever 25 is energized to the blocking portion 27 so that, when the dust collecting bag 6 is detached, the blocking portion 27 is positioned on the opening edge of the dust collecting chamber 7 to prevent the dust collecting cover 14 from being attached on the main body 5, thereby making it possible to securely prevent the misuse of the cleaner in the state where the dust collecting bag 6 is not attached.

Moreover, since the blocking portion 27 is formed as a plate, the flap 6*b* is prevented from being falling down to the opening edge of the dust collecting chamber 7 even if the flap 6*b* is integrally formed with the mouth plate 6*a* of the dust collecting bag 6, thereby making it possible to eliminate disadvantages such as air leak caused by engagement of the flap 6*b* between the cover 14 and the opening of the dust collecting chamber 7.

Furthermore, in the embodiment described above, the lever 25 is energized to the blocking portion 27 side with a spring 30. However, it is possible to suitably set the position of the swinging shaft 26 of the lever 25 to establish a configuration where the lever 25 swings to the blocking portion 27 side with self-weight in the state where the main body 5 is fallen down. In this case, it is possible to reduce the number of parts such as springs.

The present invention is not restricted to the upright type vacuum cleaner described above and can be applied to all types of cleaners such as a canister type (transversal) vacuum cleaner.

According to the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever.

Also, according to the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever. Since the other end of the lever encircles the inlet pipe, the dust collecting bag is lifted up from the whole circumference of the inlet pipe so that it is more easy to detach the dust collecting bag.

Also, according to the present invention, it is not possible to attach the cover for the dust collecting chamber to the cleaner in the state where the dust collecting bag is detached so that it is possible to securely prevent misuse of the cleaner in the state where the dust collecting bag is not attached.

Further, it is also possible to easily replace the dust collecting bag and improve operation since the dust collecting bag is lifted up by the other end of the lever by operating one end of the lever.

Moreover, the dust collecting bag will not come off accidentally since the lever is prevented from rotating by means of the restricting rib in the state where the lever is retracted in the dust collecting chamber.

Also in the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever.

Moreover, since an inclined portion is formed on the upper surface of the other end of the lever, it prevents the other end of the lever from lifting up the dust collecting bag when the dust collecting bag is detached so that the opening of the dust collecting bag will not be caught by the outside circumference of the inlet pipe, thereby making it easier to detach the dust collecting bag, with improved replacing workability.

Further, according to the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever.

Moreover, when attaching the dust collecting bag, it is possible to attach the dust collecting bag on the inlet pipe by using a method wherein the mouth plate is matched and pressed to the positioning rib formed on the other end of the lever, thereby improving the operability.

Also, according to the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever.

Moreover, since a rib is formed on the outside circumference of the inlet pipe, the other end of the lever is guided by the rib and smoothly swings when the lever swings, thereby improving the operability.

Also, according to the present invention, it is not possible to attach the cover for the dust collecting chamber to the cleaner in the state where the dust collecting bag is detached so that it is possible to securely prevent misuse of the cleaner in the state where the dust collecting bag is not attached. Further, it is also possible to easily replace the dust collecting bag and improve operation since the dust collecting bag is lifted up by the other end of the lever by operating one end of the lever.

Moreover, when attaching the dust collecting bag to the inlet pipe, it is possible to securely attach the dust collecting bag to the inlet pipe even if the position of the dust collecting bag is displaced against the inlet pipe since the opening of the dust collecting bag is guided by means of a guide portion formed on the inlet pipe.

Moreover, according to of the present invention, it is possible to easily replace the dust collecting bag and improve the operability since the dust collecting bag is lifted up by the other end of the lever by operating one end of the lever, and it is also possible to securely prevent misuse in the state where the dust collecting bag is not attached since the lever is swung to the blocking portion by means of an energizing means.

According to the present invention, it is also possible to easily replace the dust collecting bag and improve operation since the dust collecting bag is lifted up by the other end of the lever by operating one end of the lever, and it is also possible to securely prevent the misuse of the cleaner in the state where the dust collecting bag is not attached and to reduce the number of parts since the lever is swung to the blocking portion side with self-weight.

While the invention has been particularly shown and described in reference to preferred embodiments thereof, it will be understood by those skilled in the art that changes in form and details may be made therein without departing from the spirit and scope of the invention.

What we claim is:

1. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; and the one end of the lever is positioned between the opening edge of the dust collecting chamber and the cover for the dust collecting chamber while the other end of the lever is formed with an encircling portion for encircling a periphery of the inlet pipe to swing the lever by means of the dust collecting bag by attaching the dust collecting bag to the inlet pipe so that one end of the lever is retracted to the position where the lever enables the cover for dust collecting chamber to close.

2. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a restricting rib which restricts swinging of the lever at a retracted position of the lever in the dust collecting chamber is formed at a rear surface of the cover for the dust collecting chamber.

3. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a portion of the other end of the lever, the portion being on a tip end side from an approximate center portion of the inlet pipe, is inclined in a direction separating from a mouth plate of the dust collecting bag.

4. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a positioning rib for positioning a mouth plate of the dust collecting bag is formed on a top surface of the other end of the lever.

5. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a rib extending in an axial direction of the inlet pipe is formed on an outer surface of the inlet pipe.

6. A vacuum cleaner comprising: a main body having a dust collecting chamber containing a dust collecting bag and a motor chamber containing an electric blower; a cover for the dust collecting chamber freely opening and closing an opening of the dust collecting chamber; and an inlet pipe formed on the dust collecting chamber wherein a lever is provided within the dust collecting chamber, the lever being swingable between a position where one end of the lever is positioned between an opening edge of the dust collecting chamber and the cover for the dust collecting chamber to prevent the cover for the dust collecting chamber from closing and a position where the lever enables the cover for the dust collecting chamber to close; the other end of the lever is extended near the inlet pipe to swing the lever by means of the dust collecting bag by attaching the dust collecting bag to the inlet pipe so that the one end of the lever is retracted to the position where the lever enables the cover for dust collecting chamber to close; and a guide portion is integrally formed with an opening edge of the inlet pipe toward a center of the inlet pipe.

7. The vacuum cleaner of any one of claims 2 to 6, wherein a forcing means which forces the lever to a position where one end of the lever prevents the dust collecting chamber from being closed is provided.

8. The vacuum cleaner of any one of claims 2 to 6, wherein the lever is shaped so that one end of the lever is swung with self-weight to a position where the dust collecting chamber is prevented from being closed.

9. The vacuum cleaner of any one of claims 2 to 6, wherein the body is swingably supported on the sucking body.

* * * * *